US010908528B2

(12) United States Patent
Nakajima et al.

(10) Patent No.: US 10,908,528 B2
(45) Date of Patent: Feb. 2, 2021

(54) DEVELOPING DEVICE AND IMAGE FORMING APPARATUS

(71) Applicant: FUJI XEROX CO., LTD., Tokyo (JP)

(72) Inventors: Yoshitaka Nakajima, Kanagawa (JP); Tomoyuki Yoshii, Kanagawa (JP); Norihiro Tamazawa, Kanagawa (JP); Yoshifumi Ozaki, Kanagawa (JP); Masanori Kato, Kanagawa (JP); Shinichi Kuramoto, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/582,422

(22) Filed: Sep. 25, 2019

(65) Prior Publication Data

US 2020/0310280 A1 Oct. 1, 2020

(30) Foreign Application Priority Data

Apr. 1, 2019 (JP) ..... 2019-070189

(51) Int. Cl.
*G03G 15/08* (2006.01)

(52) U.S. Cl.
CPC ..... *G03G 15/0808* (2013.01); *G03G 15/0865* (2013.01)

(58) Field of Classification Search
CPC ..... G03G 15/0808
See application file for complete search history.

(56) References Cited

U.S. PATENT DOCUMENTS 8,676,094 B2 3/2014 Nakajima et al.

FOREIGN PATENT DOCUMENTS

| | | | |
|---|---|---|---|
| JP | 2009098621 A | * | 5/2009 |
| JP | 2010060625 A | * | 3/2010 |
| JP | 2012-014087 A | | 1/2012 |
| JP | 5903763 B2 | | 10/2012 |

OTHER PUBLICATIONS

JP_2009098621_A_T Machine Translation, Japan, Kikuchi.*
JP_2010060625_A_T Machine Translation, Japan, Kudo.*

* cited by examiner

*Primary Examiner* — Victor Verbitsky
(74) *Attorney, Agent, or Firm* — Sughrue Mion, PLLC

(57) ABSTRACT

A developing device includes a developer carrier on which an attraction region is set, the attraction region being a region that attracts developer including toner and a carrier, and that carries, in the attraction region, the developer that is to be supplied to an image carrier on which an electrostatic latent image is formed; a regulation member that regulates the developer so that a predetermined amount of the developer is carried by the developer carrier; and a forming unit that is located upstream of the regulation member and that forms, in the attraction region, a first region that restricts a flow of developer supplied to the developer carrier and a second region that is located between the first region and the regulation member and that does not restrict a flow of the developer compared with the first region.

9 Claims, 6 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2019-070189 filed Apr. 1, 2019.

BACKGROUND

(i) Technical Field

The present disclosure relates to a developing device and an image forming apparatus.

(ii) Related Art

For example, Japanese Unexamined Patent Application Publication No. 2012-014087 discloses a developing device including a member that blocks supply of developer at a position upstream of a development roller and that has a slit through which the developer is supplied to the development roller.

SUMMARY

In a case where developer, which is regulated by a regulation member, is attracted to and carried on a developer carrier by using a magnetic force and reduction of the amount of the developer is performed by reducing the magnetic force, the layer-forming stability of the developer carrier may be negatively influenced.

Aspects of non-limiting embodiments of the present disclosure relate to suppressing negative influence on the layer-forming stability of developer compared with a case where a forming unit is not provided, the forming unit forming, in an attraction region, a first region that restricts a flow of developer supplied to a developer carrier and a second region that is located between the first region and a regulation member and that does not restrict a flow of the developer compared with the first region.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including: a developer carrier on which an attraction region is set, the attraction region being a region that attracts developer including toner and a carrier, and that carries, in the attraction region, the developer that is to be supplied to an image carrier on which an electrostatic latent image is formed; a regulation member that regulates the developer so that a predetermined amount of the developer is carried by the developer carrier; and a forming unit that is located upstream of the regulation member and that forms, in the attraction region, a first region that restricts a flow of developer supplied to the developer carrier and a second region that is located between the first region and the regulation member and that does not restrict a flow of the developer compared with the first region.

BRIEF DESCRIPTION OF THE DRAWINGS

An exemplary embodiment of the present disclosure will be described in detail based on the following figures, wherein.

DETAILED DESCRIPTION

Hereafter, an exemplary embodiment of the disclosure will be described in detail with reference to the drawings.

Figure 1:
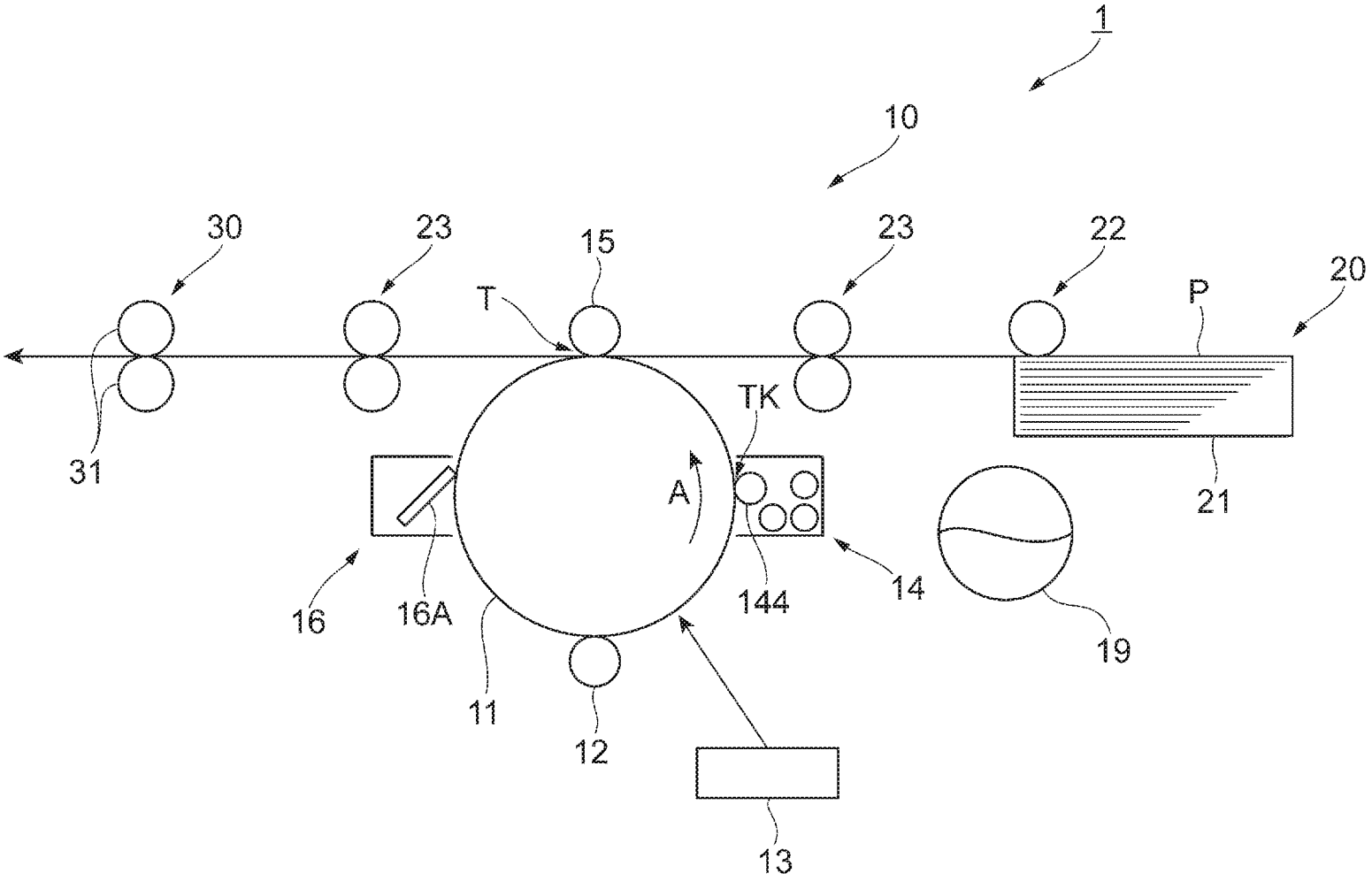
FIG. 1 illustrates the overall structure of an image forming apparatus.

FIG. 1 illustrates the overall structure of an image forming apparatus 1. To be specific, FIG. 1 illustrates the image forming apparatus 1 as seen from the front side of the image forming apparatus 1.

The image forming apparatus 1 includes an image forming unit 10, a sheet supplying unit 20, and a fixing unit 30.

The image forming unit 10 forms a toner image on a sheet P, which is an example of a recording medium, by using an electrophotographic method. The sheet supplying unit 20 supplies the sheet P to the image forming unit 10. The fixing unit 30 fixes to the sheet P the toner image, which has been formed on the sheet P by the image forming unit 10, that is, an image.

The image forming unit 10 includes a photoconductor drum 11 that rotates in the direction indicated by an arrow A. The image forming unit 10 further includes a charging roller 12, an exposure device 13, a developing device 14, a transfer roller 15, and a cleaning device 16.

The photoconductor drum 11, which is an example of an image carrier, is composed of a cylindrical body. A photosensitive layer (not shown) is formed on the surface of the cylindrical body.

The charging roller 12 is composed of an electroconductive rubber roller and the like and charges the photoconductor drum 11.

The exposure device 13 exposes the photoconductor drum 11, which has been charged by the charging roller 12, to light that is emitted from a light source, such as a laser light source or a light emitting diode (LED), and forms an electrostatic latent image on the surface of the photoconductor drum 11.

The developing device 14, which is an example of a developing unit, applies toner, having a predetermined color, to the surface of the photoconductor drum 11, and develops the electrostatic latent image, which has been formed on the photoconductor drum 11, by using the toner. Thus, in the present exemplary embodiment, a toner image is formed on the surface of the photoconductor drum 11.

A developer is contained in the developing device 14. The developer in the present exemplary embodiment is a two-component developer, which is composed of a magnetic carrier and a color toner.

Moreover, the present exemplary embodiment includes a developer container 19 that contains developer to be supplied to the developing device 14. In the present exemplary embodiment, new developer is supplied from the developer container 19 to the developing device 14 through a developer transport path (not shown).

The transfer roller 15, which is an example of a transfer unit, is composed of an electroconductive rubber roller and the like.

In the present exemplary embodiment, the transfer roller 15 and the photoconductor drum 11 face each other at a transfer region T. A toner image on the surface of the photoconductor drum 11, that is, a toner image carried by the photoconductor drum 11 is transferred to the sheet P at the transfer region T.

The cleaning device 16 includes a contact member 16A that is disposed in contact with the photoconductor drum 11. The cleaning device 16 removes substances, such as toner, adhering to the surface of the photoconductor drum 11.

In the present exemplary embodiment, the transfer roller 15 transfers a toner image to the sheet P. Instead, a structure such that the transfer roller 15 transfers a toner image to an intermediate transfer belt (not shown) may be used.

The sheet supplying unit 20 includes a sheet container 21 that contains sheets P and a feed mechanism 22 that feeds a sheet P from the sheet container 21.

Moreover, the present exemplary embodiment includes a sheet transport mechanism 23 that transports the sheet P, which has been fed from the sheet supplying unit 20, via the transfer region T and the fixing unit 30.

The fixing unit 30, which is an example of a fixing unit, includes a pair of rotational bodies 31 that rotate while being in contact with each other.

A heater (not shown) is disposed in one of the pair of rotational bodies 31.

In the fixing unit 30, the pair of rotational bodies 31 press and heat the sheet P, and a toner image on the sheet P is fixed to the sheet P.

An image forming operation performed by the image forming apparatus 1 will be described.

In the image forming unit 10, the charging roller 12 charges the photoconductor drum 11, which rotates in the direction of the arrow A. Next, the exposure device 13 exposes the surface of the photoconductor drum 11 to light, and an electrostatic latent image corresponding to image information is formed on the surface of the photoconductor drum 11.

Subsequently, the developing device 14 develops the electrostatic latent image, and a toner image corresponding to the electrostatic latent image is formed on the surface of the photoconductor drum 11.

The toner image formed on the photoconductor drum 11 moves toward the transfer region T as the photoconductor drum 11 rotates. A sheet P that has been fed from the sheet supplying unit 20 is transported by the sheet transport mechanism 23 to the transfer region T.

At the transfer region T, the toner image on the photoconductor drum 11 is transferred to the transported sheet P. Subsequently, the sheet P, to which the toner image has been transferred, is heated and pressed by passing through the fixing unit 30, and the toner image is fixed to the sheet P.

Figure 2:
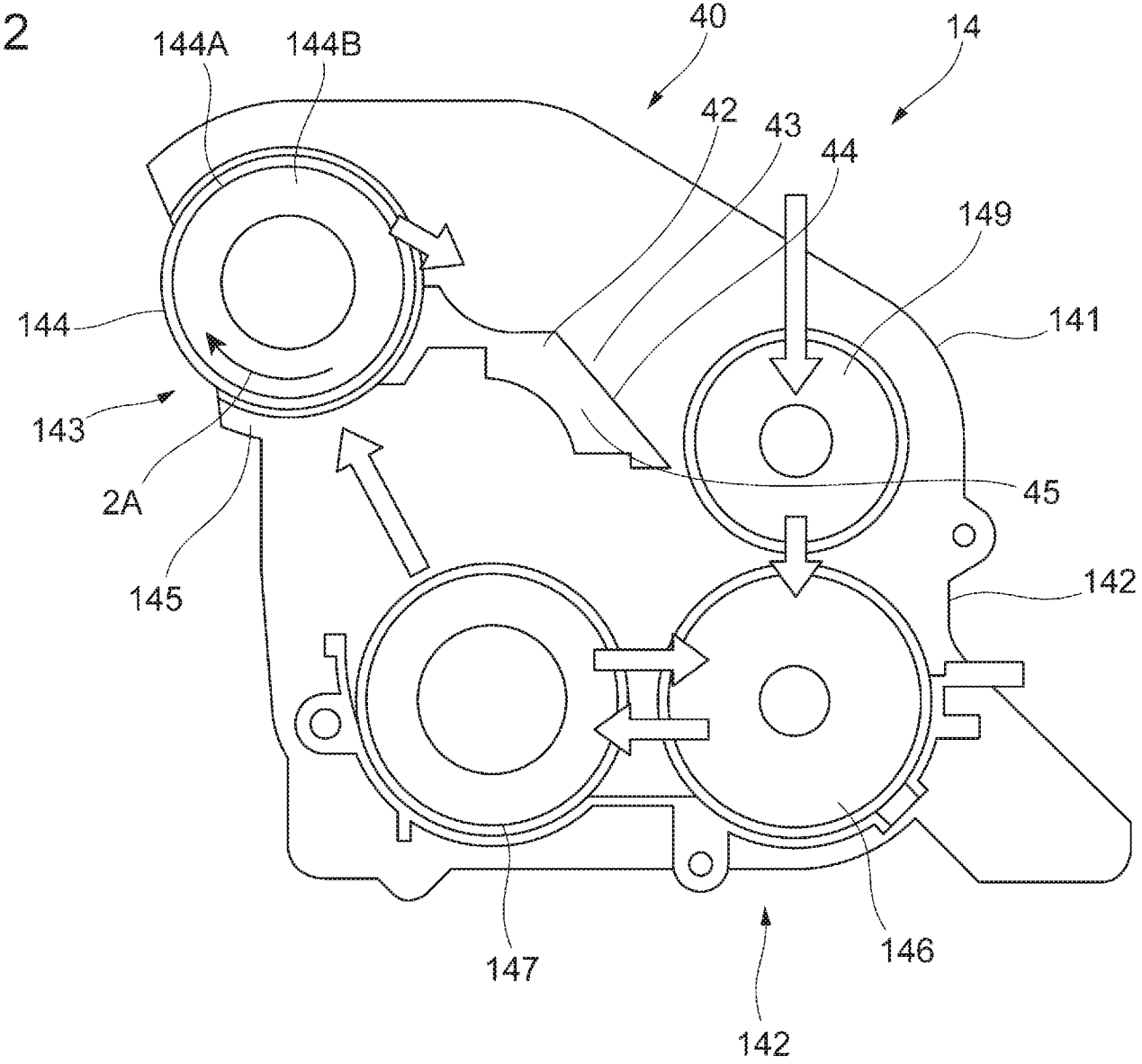
FIG. 2 illustrates a developing device.

FIG. 2 illustrates the developing device 14.

The developing device 14 includes a container unit 141 that contains developer (not shown). The container unit 141 is composed of a container case 142 made of a resin.

The container case 142 of the developing device 14 is disposed so as to extend in the direction perpendicular to the plane of FIG. 2, which is the direction from the front side toward the rear side of the image forming apparatus 1 (see FIG. 1). The container case 142 includes a distal end portion (not shown) in a rear part thereof and a front end portion (not shown) in a front part thereof.

The container case 142 has an opening 143 in a part thereof facing the photoconductor drum 11 (see FIG. 1). In the opening 143, a development roller 144, which applies the developer to the surface of the photoconductor drum 11, is disposed.

The development roller 144, which is an example of a developer carrier, has a cylindrical shape and extends in the direction from the front side toward the rear side of the image forming apparatus 1. In other words, the development roller 144 is disposed so as to extend in the longitudinal direction of the developing device 14.

The development roller 144 includes a development sleeve 144A that is composed of a cylindrical body and rotates and a magnet roller 144B that is disposed inside the development sleeve 144A.

The development sleeve 144A is made of a metal such as a stainless steel. The development sleeve 144A rotates in the direction of an arrow 2A in FIG. 2.

Moreover, in the present exemplary embodiment, the development sleeve 144A and the photoconductor drum 11 rotate in such a way that the development sleeve 144A and the photoconductor drum 11 move in the same direction at a facing region TK (see FIG. 1) where the development roller 144 and the photoconductor drum 11 face each other.

The developing device 14 includes a layer regulation member 145 that regulates the thickness of a layer of the developer to be carried by the development roller 144. The layer regulation member 145 is made of a metal. The layer regulation member 145 is an example of a regulation member that regulates the developer so that a predetermined amount of the developer is carried by the development roller 144.

As illustrated in FIG. 2, the developing device 14 includes a first transport member 146 and a second transport member 147 that transport the developer.

The first transport member 146 and the second transport member 147, which are examples of a plurality of rotation members, are disposed at positions that are opposite the position of the photoconductor drum 11 (see FIG. 1) with respect to the development roller 144.

The first transport member 146 has a rotation axis that is parallel to the rotation axis of the development sleeve 144A that rotates. The first transport member 146 rotates around the rotation axis thereof and transfers the developer in the container unit 141.

In the developing device 14 structured as described above, new toner that is supplied from the developer container 19 or toner to which a very small amount of carrier is added is transported in a circulating manner between the first transport member 146 and the second transport member 147 while being agitated. To be more specific, by transferring the developer through connection holes that are formed in two end portions of a partition wall extending in the axial direction, the developer that has been agitated by the first transport member 146 is agitated by the second transport member 147 and can be agitated further by the first transport member 146. In the developing device 14, a circulation path, which is a path along which the developer is circulated in the axial direction by rotation of each of the first transport member 146 and the second transport member 147, is formed.

The developing device 14 includes a third transport member 149 that is located above the first transport member 146. The third transport member 149 is an example of another rotation member.

A transport path formed by rotation of the third transport member 149 is connected to the circulation path. The third transport member 149 receives recovered developer, which is developer removed and recovered from the development roller 144, and toner from the developer container 19 or toner to which a very small amount of carrier is added. Then, the third transport member 149 transports the recovered developer and the toner while agitating the mixture of these and discharges the mixture to the first transport member 146 in the circulation path.

Thus, in the present exemplary embodiment, the recovered developer is agitated and transported together with the new developer in the axial direction by the third transport member 149. Moreover, the recovered developer and the new developer are further agitated and transported by the first transport member 146 and the second transport member 147. Therefore, the distance along which the developer is agitated or the time for which the developer is agitated are increased, compared with a case where the third transport member 149 is not provided.

The development roller 144, the layer regulation member 145, the first transport member 146, the second transport member 147, and the third transport member 149 are disposed substantially parallel to the photoconductor drum 11 (see FIG. 1). The present exemplary embodiment includes the first transport member 146, the second transport member 147, and the third transport member 149, as members for agitating and transporting the developer. However, the structure of the developing device 14 is not limited to this. It is conceivable that an exemplary structure includes the first transport member 146 and the second transport member 147 and does not include the third transport member 149.

Next, a recovered-developer transport unit 40, which transports the recovered developer of the development roller 144 to the third transport member 149 in the developing device 14, will be described. In the exemplary structure that does not include the third transport member 149, the recovered-developer transport unit 40 transports the recovered developer of the development roller 144 to the first transport member 146 or the second transport member 147.

As illustrated in FIG. 2, an upstream part of the recovered-developer transport unit 40 has a curved surface 42. The curved surface 42 is convex downward. The curved surface 42 is a surface that is used for the recovered developer so that the recovered developer can be smoothly transferred from the development roller 144 to the third transport member 149.

As illustrated in FIG. 2, a downstream part of the recovered-developer transport unit 40 has a transport surface 43 that transports the recovered developer to the third transport member 149. In the present exemplary embodiment, the transport surface 43 includes an inclined surface 44 that allows the recovered developer to fall along an inclination thereof. The inclined surface 44 is inclined substantially linearly. The recovered developer slides along the inclined surface 44 by gravity toward the third transport member 149.

In the present exemplary embodiment, the curved surface 42 and the inclined surface 44 are formed in one member 45. However, the curved surface 42 and the inclined surface 44 may be formed in different members.

The recovered-developer transport unit 40 is an example of a guide unit.

Figure 3:
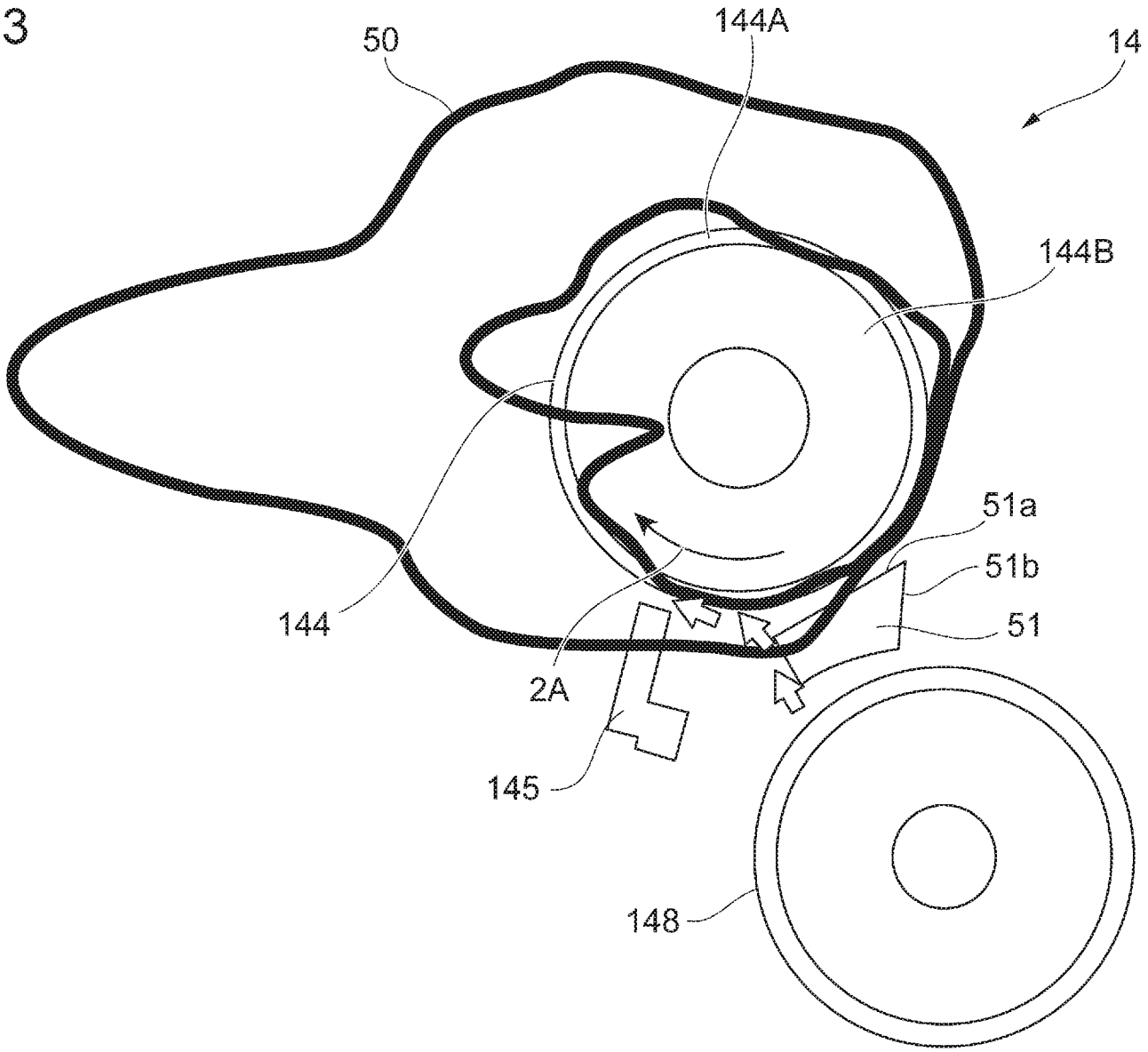
FIG. 3 illustrates a developer attracting region.

FIG. 3 is a partially enlarged view of FIG. 2, illustrating a developer attracting region 50.

The development roller 144 of the developing device 14 has plural magnetic poles (not shown) that are arranged in the circumferential direction of the magnet roller 144B. Thus, a magnetic-attractive-force distribution in a direction normal to the surface of the development roller 144 is set as shown by a thick line in FIG. 3. The developer attracting region 50 is the region inside the magnetic-attractive-force distribution, where the developer can be attracted onto the development roller 144. The developer attracting region 50, which is an example of an attraction region, is set by the positions and the types of the plural magnetic poles that are disposed in the development roller 144. Thus, a region and a magnetic force that are necessary for achieving a sufficient layer-forming stability and a sufficient image-quality stability are reliably obtained.

The developing device 14 includes a restriction member 51 that is disposed upstream of the layer regulation member 145. The restriction member 51, which is an example of a forming unit, partially restricts the flow of developer supplied to the development roller 144. The restriction member 51 may be made of a non-magnetic material and may have a film-like shape.

The restriction member 51 has a surface 51*a* that faces the development roller 144 and that intersects the developer attracting region 50 (the inside of the thick line). An upstream part of the surface 51*a* is located outside the developer attracting region, and a downstream part of the surface 51*a* is located inside the developer attracting region.

Figure 4:
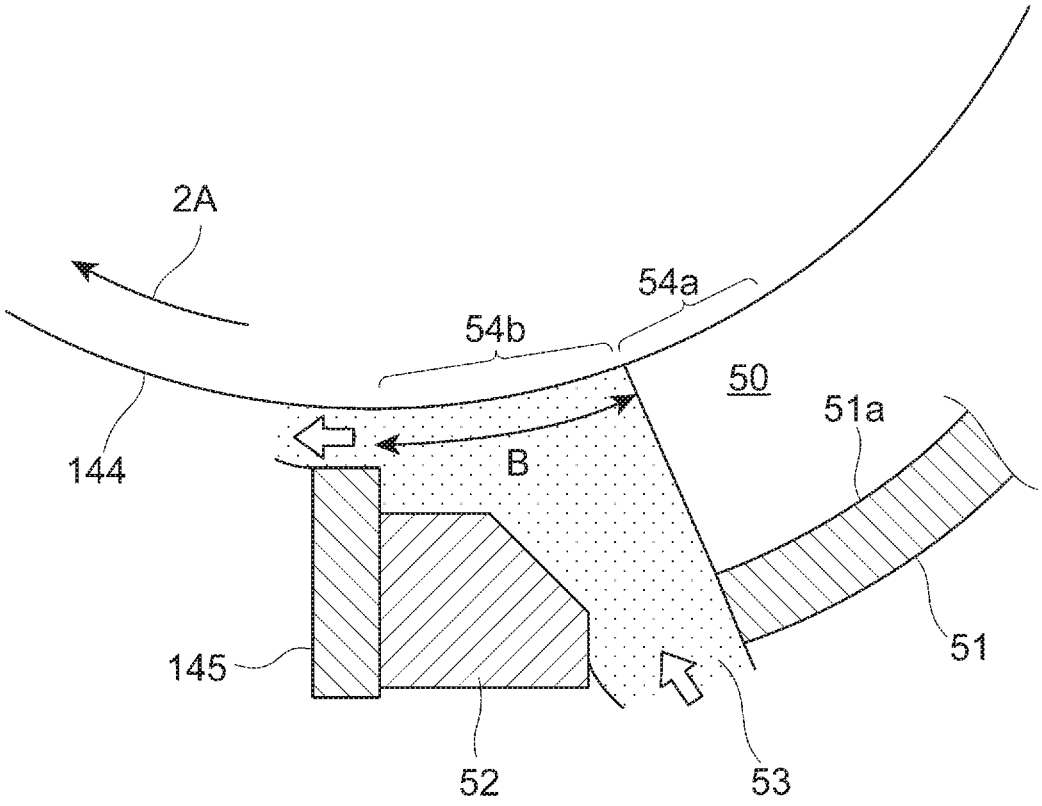
FIG. 4 illustrates a flow of developer to a development roller.

FIG. 4 is a partially enlarged view of FIG. 3, illustrating a flow of developer to the development roller 144.

As illustrated in FIG. 4, the developing device 14 includes a block member 52 that is disposed between the restriction member 51 and the layer regulation member 145. The developing device 14 has a supply port 53 that is formed between the restriction member 51 and the block member 52 and through which the developer is supplied to the development roller 144. Due to the presence of the supply port 53, a flow of developer is formed in a region downstream of the restriction member 51 (see arrows in FIG. 3 or 4). In the present exemplary embodiment, the block member 52, together with the restriction member 51, is an example of a forming unit.

The restriction member 51 and the block member 52 form plural regions that differ from each other with respect to the flow of developer that is supplied to the development roller 144 in the developer attracting region 50. That is, the restriction member 51 and the block member 52 form a first region 54*a* that restricts the flow of developer and a second region 54*b* that does not restrict the flow of developer compared with the first region 54*a*. The second region 54*b* is located downstream of the first region 54*a* in the rotation direction of the development roller 144. The second region 54*b* is located on the peripheral surface of the development roller 144 between the first region 54*a* and the layer regulation member 145.

The first region 54*a* is a region that is not used to attract the developer to the development roller 144, although the first region 54*a* is capable of attracting the developer. The second region 54*b* is a region that is capable of attracting the developer to the development roller 144 and that is used to attract the developer. The first region 54*a* is an example of a first region, and the second region 54*b* is an example of a second region.

Because the first region 54*a* and the second region 54*b*, which differ from each other with respect to the flow of developer, are formed in the developer attracting region 50, an attraction region in which the developer is attracted to the development roller 144 due to the magnetic force of the development roller 144 or an attraction width B (hereafter, referred to as the attraction width B) is narrowed. The attraction width B refers to a length as seen in the direction of the axial direction of the development roller 144. The attraction width B is proportional to the amount of developer that can be attracted to the development roller 144. Moreover, the attraction width B is proportional to the magnetic force acting on the development roller 144. With the present exemplary embodiment, because the attraction width B is reduced, the amount of developer attracted to the development roller 144 is reduced, and the magnetic force acting on the development roller 144 is also reduced.

To be more specific, in the present exemplary embodiment, the supply port 53 is disposed downstream of the restriction member 51. If it is assumed that the supply port 53 is disposed upstream of the restriction member 51, the attraction width B is increased, the amount of developer attracted to the development roller 144 is increased, and it becomes difficult to reduce bending of the development roller 144 or a stress applied to the development roller 144. To avoid this, for example, it is conceivable that the amount of attracted developer may be reduced by placing the restriction member 51 closer to the development roller 144.

However, when the restriction member 51 is placed closer to the development roller 144, if a space upstream of the layer regulation member 145 becomes narrower, the regulated developer has no place to go, a stagnant region where the developer does not move is generated, and, as a result, an image defect such as a color dot may occur.

In the present exemplary embodiment, the attraction width B is reduced by shifting the flow of developer closer to the layer regulation member 145 by using the structure described above. Thus, occurrence of an image defect is suppressed while suppressing increase of the amount of developer attracted to the development roller 144, without placing the restriction member 51 closer to the development roller 144.

Figure 5:
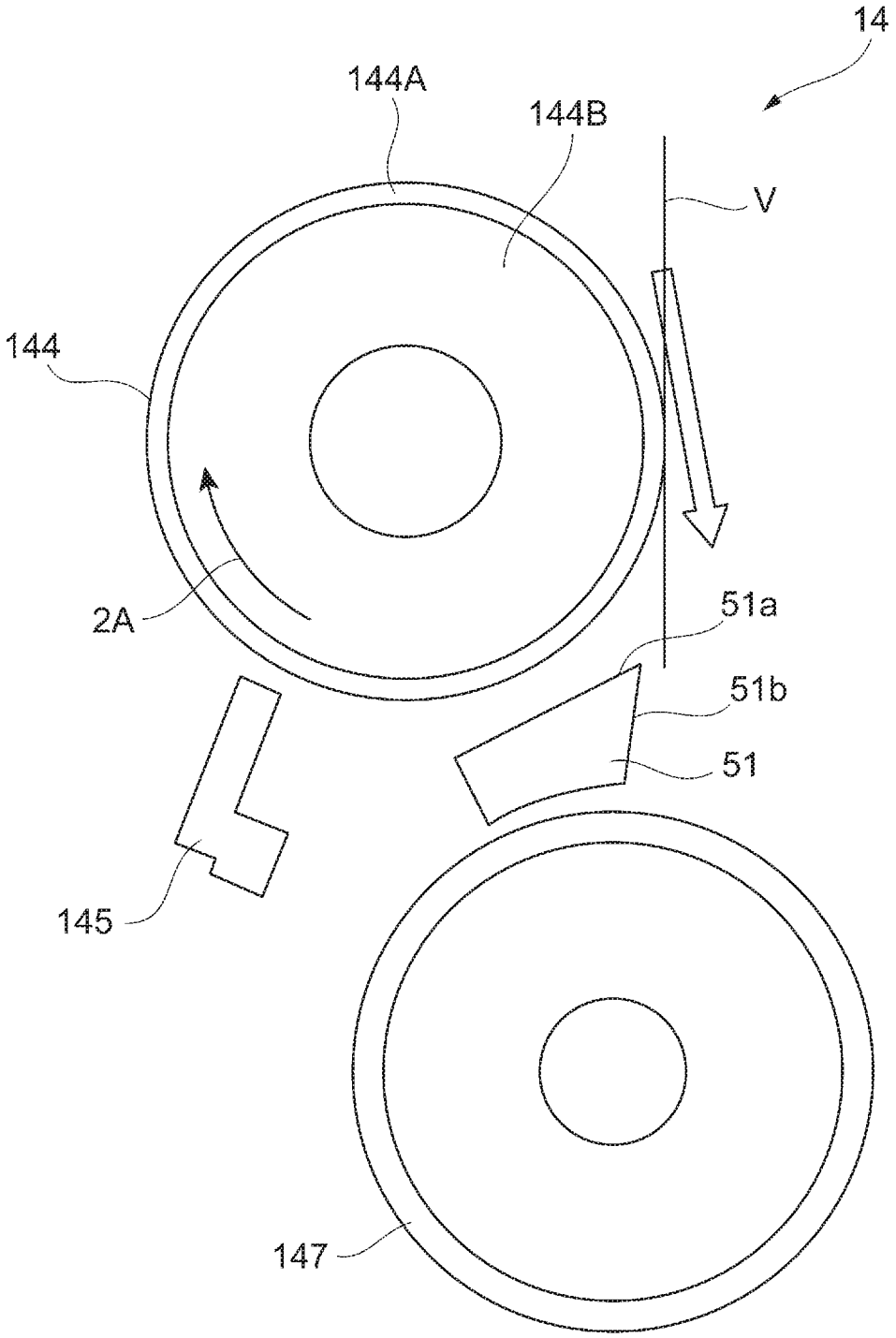
FIG. 5 illustrates a flow of developer removed from the development roller.

FIG. 5 is a view corresponding to FIG. 3, illustrating a flow of developer removed from the development roller 144.

As illustrated in FIG. 5, the restriction member 51 is disposed in such a way that an upstream end portion 51*b* is located closer than a removal-side tangent line V of the development roller 144, which extends in the up-down direction, to the layer regulation member 145. The restriction member 51 is an example of a restriction unit, an example a first member, and an example of a first-region forming portion.

The restriction member 51 restricts a flow of the developer removed from the development roller 144 toward the developer attracting region 50. Thus, entry of the removed developer into a space between the development roller 144 and the restriction member 51 is suppressed. Therefore, the removed developer, which has a low toner concentration, is prevented from being carried by the development roller 144.

Figure 6:
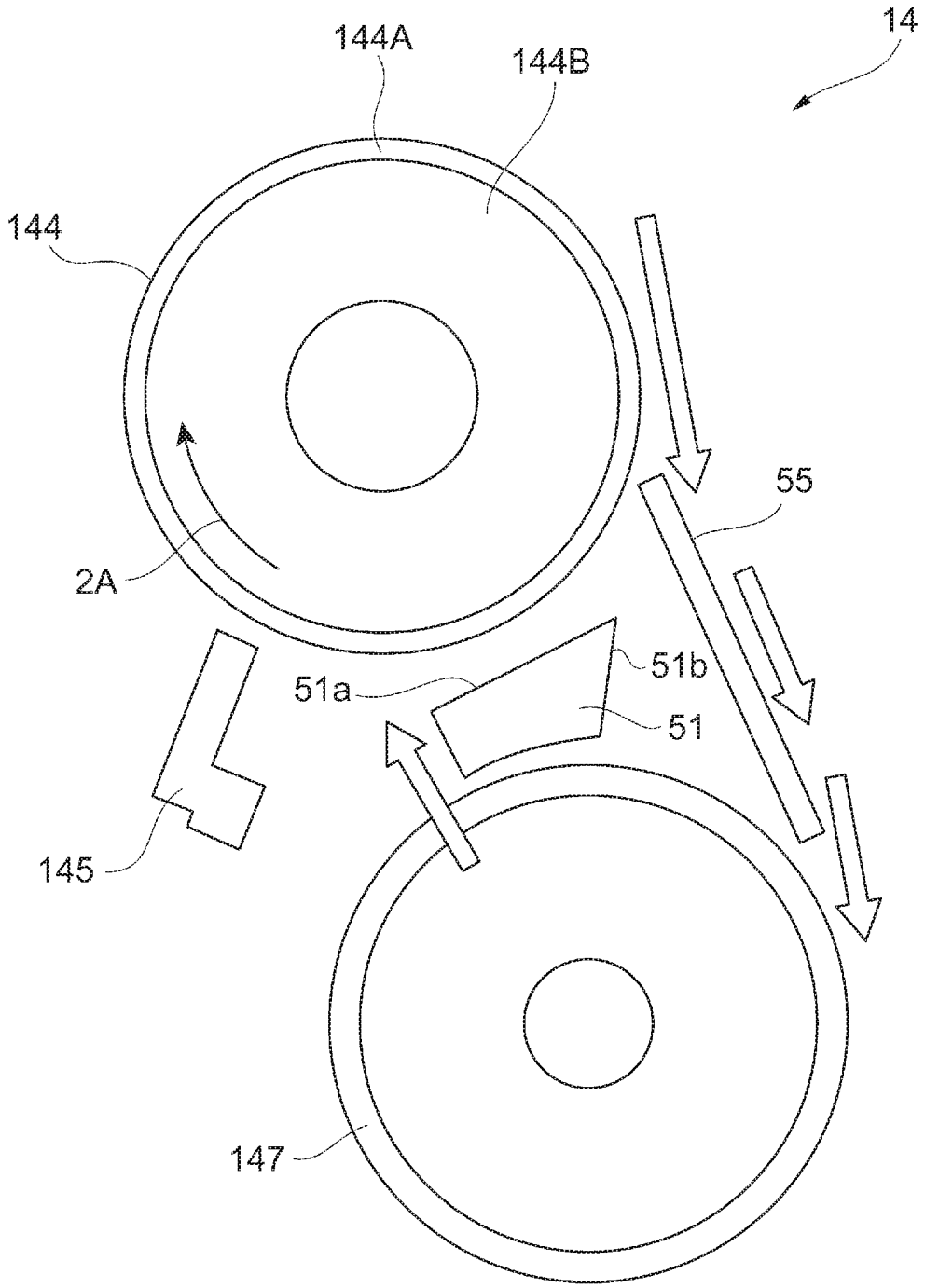
FIG. 6 illustrates a developing device according to a modification.

FIG. 6 is a view corresponding to FIG. 5, illustrating a developing device 14 according to a modification.

The developing device 14 according to the modification illustrated in FIG. 6 includes a guide member 55 that is located upstream of the restriction member 51 and that guides the removed developer to a transport path formed by rotation of the third transport member 149 (see FIG. 2). The guide member 55, which is an example of a restriction unit and an example of a guide member, is disposed in such a way that an upper end thereof is located adjacent to the development roller 144, a lower end thereof is located adjacent to the second transport member 147, and the guide member 55 covers a space between the development roller 144 and the second transport member 147. The guide member 55 prevents the developer removed from the development roller 144 from moving toward the restriction member 51.

In the present modification, the guide member 55 guides the removed developer to the transport path (see FIG. 2) that is formed by rotation of the third transport member 149. However, the guide member 55 may guide the removed developer to the circulation path (see FIG. 2) in which developer is circulated in the axial direction by rotation of each of the first transport member 146 and the second transport member 147.

The guide member 55 and the restriction member 51 are different members. However, this is not a limitation. The guide member 55 may be integrally formed with the restriction member 51.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a developer carrier on which an attraction region is set, the attraction region being a region that attracts developer including toner and a carrier, and that carries, in the attraction region, the developer that is to be supplied to an image carrier on which an electrostatic latent image is formed;

a regulation member that regulates the developer so that a predetermined amount of the developer is carried by the developer carrier; and a forming unit that is located upstream of the regulation member, in a direction of movement of a surface of the developer carrier adjacent the regulation member, and that forms, in the attraction region, a first region that restricts a flow of developer supplied to the developer carrier and a second region that is located between the first region and the regulation member and that does not restrict a flow of the developer compared with the first region, wherein the second region is formed by a blocking member and an opening portion, the blocking member being disposed downstream in the direction of movement of the surface of the developer carrier from the opening portion.

2. The developing device according to claim 1, further comprising:

a restriction unit that restricts movement of developer removed from the developer carrier toward the attraction region.

3. The developing device according to claim 2, wherein the restriction unit includes a first member that forms the first region in the forming unit and that has a removal-side end portion that is disposed closer to the regulation member than a removal-side tangent line of the developer carrier extending in an up-down direction.

4. The developing device according to claim 2, wherein the restriction unit includes a guide member that is located upstream of a first-region forming portion that forms the first region in the forming unit, and that guides the removed developer to a path that is formed by rotation of each of a plurality of rotation members and along which the developer to be supplied to the developer carrier is transported while being agitated.

5. The developing device according to claim 4, wherein the first-region forming portion and the guide member are integrally formed.

6. The developing device according to claim 1, further comprising:

a guide unit that guides, by using a driving force, the developer removed from the developer carrier to a path that is formed by rotation of each of a plurality of rotation members and along which the developer to be supplied to the developer carrier is transported while being agitated.

7. The developing device according to claim 6, wherein the guide unit guides the removed developer by using another rotation member that is different from the plurality of rotation members and discharges the removed developer to the path.

8. An image forming apparatus comprising:

an image carrier on which an electrostatic latent image is formed;

a developing unit that develops the electrostatic latent image formed on the image carrier into a toner image;

a transfer unit that transfers the toner image formed by the developing unit onto a recording medium; and a fixing unit that fixes the toner image transferred onto the recording medium to the recording medium, wherein the developing unit includes a developer carrier on which an attraction region is set, the attraction region being a region that attracts developer including toner and a carrier, and that carries, in the attraction region, the developer that is to be supplied to the image carrier on which the electrostatic latent image is formed, a regulation member that regulates the developer so that a predetermined amount of the developer is carried by the developer carrier, and a forming unit that is located upstream of the regulation member, in a direction of movement of a surface of the developer carrier adjacent the regulation member, and that forms, in the attraction region, a first region that restricts a flow of developer supplied to the developer carrier and a second region that is located between the first region and the regulation member and that does not restrict a flow of the developer compared with the first region, wherein the second region is formed by a blocking member and an opening portion, the blocking member being disposed downstream in the direction of movement of the surface of the developer carrier from the opening portion.

9. A developing device comprising:

a developer carrier on which an attraction region is set, the attraction region being a region that attracts developer including toner and a carrier, and that carries, in the attraction region, the developer that is to be supplied to an image carrier on which an electrostatic latent image is formed;

a regulation member that regulates the developer so that a predetermined amount of the developer is carried by the developer carrier; and forming means for forming, in the attraction region, a first region that restricts a flow of developer supplied to the developer carrier and a second region that is located between the first region and the regulation member and that does not restrict a flow of the developer compared with the first region, the forming means being located upstream of the regulation member.

* * * * *